US012685383B2

(12) United States Patent
Bergström

(10) Patent No.: US 12,685,383 B2
(45) Date of Patent: Jul. 21, 2026

(54) CARRYING DEVICE AND METHOD FOR HANDLING A CARRYING DEVICE

(71) Applicant: Novalia AB, Falun (SE)

(72) Inventor: Lars Bergström, Falun (SE)

(73) Assignee: Novalia AB, Falun (SE)

( * ) Notice: Subject to any disclaimer, the term of this patent is extended or adjusted under 35 U.S.C. 154(b) by 262 days.

(21) Appl. No.: 18/414,719

(22) Filed: Jan. 17, 2024

(65) Prior Publication Data

US 2024/0245202 A1 Jul. 25, 2024

(30) Foreign Application Priority Data

Jan. 19, 2023 (SE) ..... 2350044-0

(51) Int. Cl.
*A45F 3/04* (2006.01)
*A44B 11/25* (2006.01)
(Continued)

(52) U.S. Cl.
CPC ..... *A45F 3/04* (2013.01); *A44B 11/2526* (2013.01); *A44B 11/266* (2013.01); *A44B 13/02* (2013.01)

(58) Field of Classification Search
CPC ..... A45F 3/04; A44B 11/2526; A44B 11/266; A44B 13/02
(Continued)

(56) References Cited

U.S. PATENT DOCUMENTS 3,655,106 A * 4/1972 Wojcinski ..... F41C 33/002 D22/108
4,858,797 A * 8/1989 Rabska ..... A62C 33/00 224/651
(Continued)

FOREIGN PATENT DOCUMENTS

EP 250578 A1 1/1988
KR 20-2014-0002029 U 4/2014
(Continued)

OTHER PUBLICATIONS

DE20203685U1; "Avalanche Shovel Back Protector Combination"; Hyve; Jul. 17, 2003 (Year: 2003).*
(Continued)

*Primary Examiner* — Nathan J Newhouse
*Assistant Examiner* — Lester L Vanterpool
(74) *Attorney, Agent, or Firm* — Harness, Dickey & Pierce, P.L.C.; Anthony G. Fussner

(57) ABSTRACT

A carrying device (10) comprises one or more storage pouches (12), at least one shoulder strap (14), intended for carrying, connected to the storage pouch. An attachment member (20) is intended for attachment of a long narrow object (3) and comprises a first part (21) and a second part (22), being releasable from one another. The first and second parts have a respective connecting end and a respective fixation end. The connecting ends are configured to receive and lock one another. The fixation end of the second part is configured to allow attachment to a long narrow object (3). The fixation end of the first part is fastened on the storage pouch, the shoulder strap or a frame, at a position proximally behind one of the shoulders (4), thereby allowing freedom of when said long narrow object is secured. A method for handling a carrying device is also disclosed.

3 Claims, 6 Drawing Sheets

(51) Int. Cl.
*A44B 11/26* (2006.01)
*A44B 13/02* (2006.01)

(58) Field of Classification Search
USPC ..... 224/600
See application file for complete search history.

(56) References Cited

U.S. PATENT DOCUMENTS 5,934,533 A * 8/1999 Callanan ..... A63C 11/023 224/250
6,152,338 A * 11/2000 Smith ..... A45F 3/14 224/675
6,290,114 B1 * 9/2001 Berberian ..... A45F 3/04 224/916
6,763,987 B1 * 7/2004 Eberle ..... A45F 3/04 224/652
7,654,426 B2 * 2/2010 Eberle ..... F41C 33/0209 224/652
7,735,701 B2 * 6/2010 Eberle ..... A45F 3/04 224/916
8,814,020 B2 * 8/2014 Yaeger ..... A45F 3/06 224/665
8,943,730 B2 * 2/2015 Ascano ..... F41C 33/007 42/94
9,074,840 B2 * 7/2015 Andersen ..... F41C 33/06
9,194,655 B1 * 11/2015 Cha ..... A45F 3/14
2005/0000995 A1 1/2005 Eberle
2006/0163304 A1 * 7/2006 Slesar ..... A45F 5/02 224/601
2007/0145091 A1 * 6/2007 Meesey ..... F41C 33/06 224/637
2007/0145092 A1 6/2007 Eberle
2011/0042427 A1 * 2/2011 Goransson-Sonnefelt ..... F41C 33/005 224/682
2015/0168097 A1 * 6/2015 Echevarria ..... F41C 33/002 224/150
2019/0293385 A1 * 9/2019 Gorton ..... A45F 3/14

FOREIGN PATENT DOCUMENTS

RU 2703754 C2 10/2019
SE 534103 C2 4/2011

OTHER PUBLICATIONS

DE20203685U1; "Avalanche Shovel Back Protector Combination", Hyve; A01B 1/022; Jul. 17, 2003 (Year: 2003).*
GB2623105A; "An Improved Ski Securing Mechanism" Antoniou, Michael; Apr. 10, 2024 (Year: 2024).*
Swedish Search Report for SE2350044-0 filed Jan. 19, 2023 that is the parent application to the instant application; dated Sep. 13, 2023; 11 pages.
Extended European Search Report corresponding to Application No. 24152751.4 dated May 16, 2024.
Swedish Office Action for SE2350044-0 filed Jan. 19, 2023 that is the parent application to the instant application; dated Jan. 25, 2024; 7 pages.
Amazon Fashion; 60 Pieces 3/8 Inch Side Release Buckles, Black Click Buckle Replacement Buckle Clip for Bags Dog Collar Webbing Backpack Accessories Datasheet; Jul. 2, 2020; https://www.amazon.se/-en/Release-Plastic-Replacement-Backpack-Accessories/db/B07X39H27S?language=en_GB; 5 pages.

* cited by examiner

CARRYING DEVICE AND METHOD FOR HANDLING A CARRYING DEVICE

CROSS-REFERENCE TO RELATED APPLICATION

This application claims the benefit of and priority to Swedish Patent Application Number 2350044-0 filed Jan. 19, 2023. The entire disclosure of this provisional patent application is incorporated herein by reference.

TECHNICAL FIELD

The present technology relates in general to carrying devices and in particular to carrying devices for long narrow objects and methods for handling such carrying devices.

BACKGROUND

Carrying long narrow objects while moving in rough or semi-rough terrain brings with it several problems to a user carrying such an object. One problem is that when such an object is carried in the hands of the user, the risk of injury increases as the stability of the user is impaired. Additionally, the ability of the user to counter a fall is reduced as the hands of the user are occupied by the long narrow object. Furthermore, objects of different types may further increase the risk of injury to the user. If the object is a weapon, risk of accidental discharge of the weapon or damage to the weapon exists. As another example, if the object carried by the user comprise sharp edges, such as an axe, increased risks of injury to the user exist.

Commonly, long narrow objects may be secured on the user, using various carrying devices. For example, a rifle may be carried using its weapon strap. However, the weapon strap is a direct inconvenience when the weapon is in use. Furthermore, during a hunting session, it is common to also carry other types of items, such as clothes, food, spare equipment etc. It is in such cases very common to carry such items in a backpack. However, since a backpack typically is carried by means of shoulder straps, such shoulder straps compete about the space with e.g. a weapon strap. Hence, it is tricky to carry both a backpack with shoulder straps and a weapon with a weapon strap at the same time in a manner that is suitable for moving in rough or semi-rough terrain by feet or by skis. One hand will also still be occupied by holding the weapon.

The published U.S. Pat. No. 3,655,106 A and the published Russian patent RU 2703754 C2 discloses carrying devices utilizing the rifle strap in order to mount the rifle in a carrying position, in so freeing both hands of the intended user. Meanwhile the published Swedish patent SE 534103 C2 and the published U.S. Pat. No. 6,152,338 A discloses other carrying devices, wherein the rifle is mounted on the anterior side of the user without relying on a rifle strap, in so leaving the hands of the user free. However in these carrying devices, the object carried (the rife) is left as an inconvenient obstacle to the user. The published U.S. Pat. Nos. 9,194,655 B1 and 6,152,338 A disclose similar carrying devices, wherein the object is instead mounted on the dorsal side of the intended user, a mounting position which does not hinder the intended user but leaves the object much more unavailable to the intended user. Hence, despite many different solutions for carrying long-narrow objects such as a weapon, there is a need for a carrying solution which does not hinder the availability of the carried object.

SUMMARY

Therefore, it is a general object of the present invention to alleviate the problems that arise when carrying a long narrow object in a carrying device, particularly in combination with other items to be carried. This above object is achieved by methods and devices according to the independent claims. Preferred embodiments are defined in dependent claims.

In general words, in a first aspect, there is provided a carrying device for long narrow objects. The carrying device comprises one or more storage pouch(es) and at least one shoulder strap connected to the storage pouch(es), optionally via a frame. The shoulder strap(s) is configured to allow the storage pouch(es) to be carried on the intended users back. The carrying device further comprise an attachment member intended for attachment of a long narrow object. The attachment member comprises a first part and a second part, being releasable from one another. The first and second parts have respective connecting ends and respective fixation ends. The connecting ends of the first and second parts of the attachment member are configured to receive one another and lock the first and second parts of the attachment member together. The fixation end of the second part of the attachment member, is configured to allow attachment to a long narrow object. The fixation end of the first part of the attachment member, is fastened on the storage pouch(es), the shoulder strap(s) or the frame, at a position relative to the intended user which is proximally behind one of the shoulders of the intended user. Thereby freedom of motion is allowed to the intended user when the long narrow object is secured in the carrying device.

In a second aspect, there is provided a method for handling a carrying device for the use with a long narrow object. The carrying device has storage pouch(es) and shoulder strap(s) connected to the storage pouch(es), optionally via a frame, and an attachment member intended for attachment of the long narrow object. The attachment member has a first part and a second part, being releasable from each other. A fixation end of the first part of the attachment member is fastened on the storage pouch(es), the shoulder strap(s) or the frame at a position relative to the intended user which is proximally behind one of the shoulders of the intended user, wherein the method comprises the steps of attaching a fixation end of the second part of the attachment member to the long narrow object and locking a connecting end of the first part of the attachment member to a connecting end of the second part of the attachment member, applying the carrying device onto a back of a user by means of the shoulder strap(s), whereby the long narrow object becomes positioned behind a shoulder of the user, allowing freedom of motion for the user. The long-narrow object can be retrieved by the user by releasing the connecting end of the first part of the attachment member from the connecting end of the second part of the attachment member, allowing the long narrow object to be easily retrievable for the intended user without removing said carrying device from the back of the user.

One advantage with the proposed technology is that a long narrow object may be carried in a comfortable and secure manor also in situations where the long-narrow object may be required to be ready for use within a moment's notice. Other advantages will be appreciated when reading the detailed description.

BRIEF DESCRIPTION OF THE DRAWINGS

The invention, together with further objects and advantages thereof, may best be understood by making reference to the following description taken together with the accompanying drawings, in which.

DETAILED DESCRIPTION

Long narrow-objects, such as a weapon or an axe are commonly carried when travelling in rough or semi-rough terrain. Fastening of such long-narrow objects securely to the user, using e.g. a carrying device, instead of having the user carry the long-narrow object in hand is preferred as free user hands reduce the risk of falling while simultaneously increasing comfort. However, fastening such a long-narrow object in a carrying device brings with it its own set of problems, as was discussed briefly in the background. This is particularly accentuated when additional items, such a s clothes, food or spare parts also are expected to be carried. Furthermore, the steps of fastening and removing the long-narrow object from its carrying position is a tedious process which leaves the object unavailable to the user when mounted in its carrying position. In situations where the object may be required for use within a moment's notice, fastening of the object to the user may not be a viable option, resulting in that the object is carried in the hands of the user despite the presence of a carrying device. The present invention aims to frees the hands of the user when carrying a long-narrow object while still leaving the long-narrow object readily available to the user. For a better understanding of the proposed technology, it may be useful to begin with a brief overview of an embodiment of a proposed carrying device. Throughout the drawings, the same reference numbers are used for similar or corresponding elements.

Figure 1:
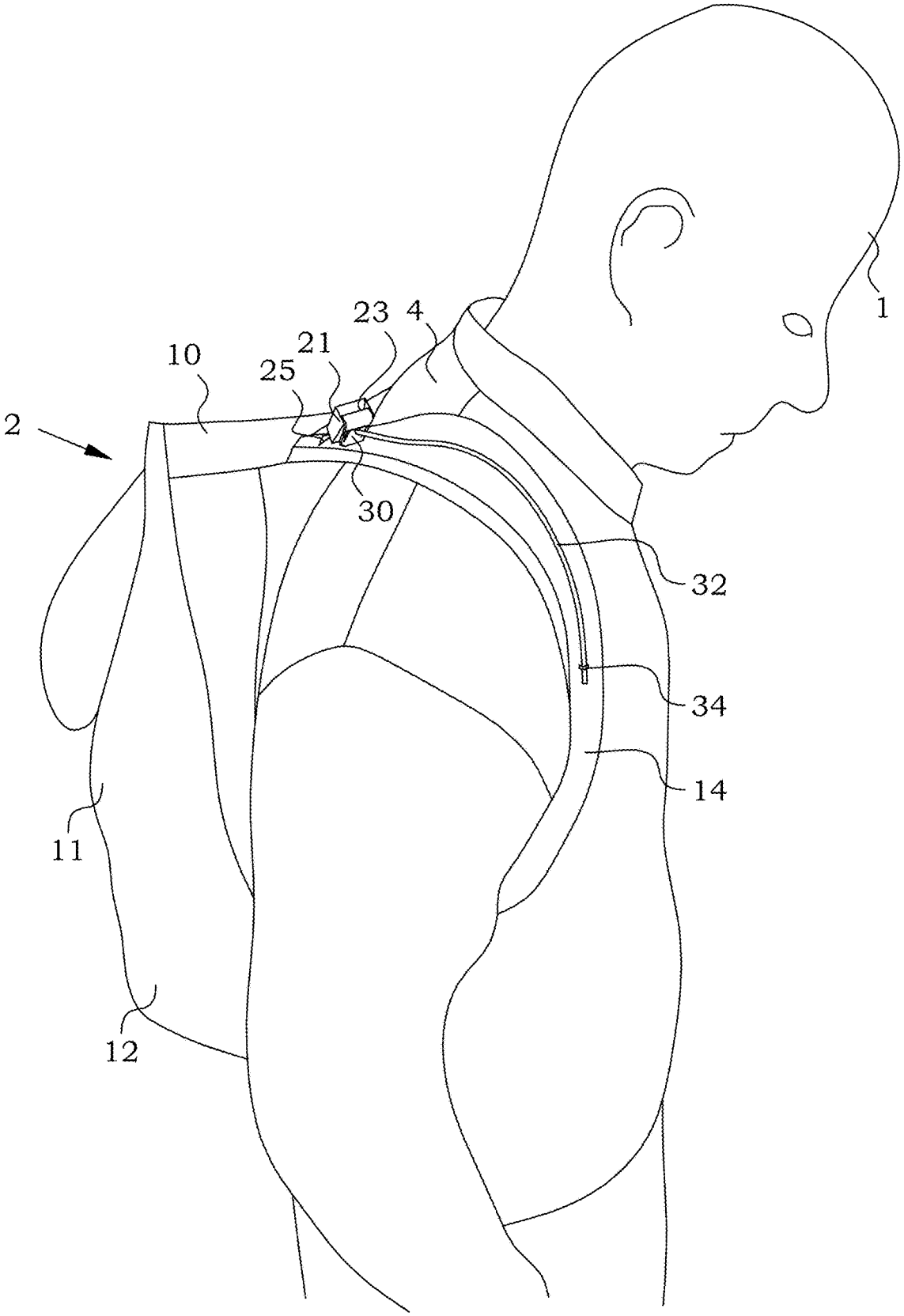
FIG. 1 is a schematic illustration of an embodiment of a carrying device.

The carrying device 10 of the embodiment shown in FIG. 1 comprises a storage pouch 12 which is suitable for storage of various items. In alternative embodiments, there may be a plurality of pouches available. These pouches are intended to provide spaces for carrying additional items, such as clothes, food, spare parts etc. The particular variety of items possible to store in the storage pouch 12 is not a concern of the present invention and is therefore not further discussed. The carrying device 10 further comprises shoulder straps 14 connected to the storage pouch 12. Alternative embodiments may have only one shoulder strap. Also in alterative embodiments, the shoulder straps may also be connected to the storage pouch via e.g. a frame. The purpose of the shoulder straps 14 and their configuration with respect to the storage pouch 12 is to allow the storage pouch 12 to be carried on the intended user's 1 back 2.

Figure 2:
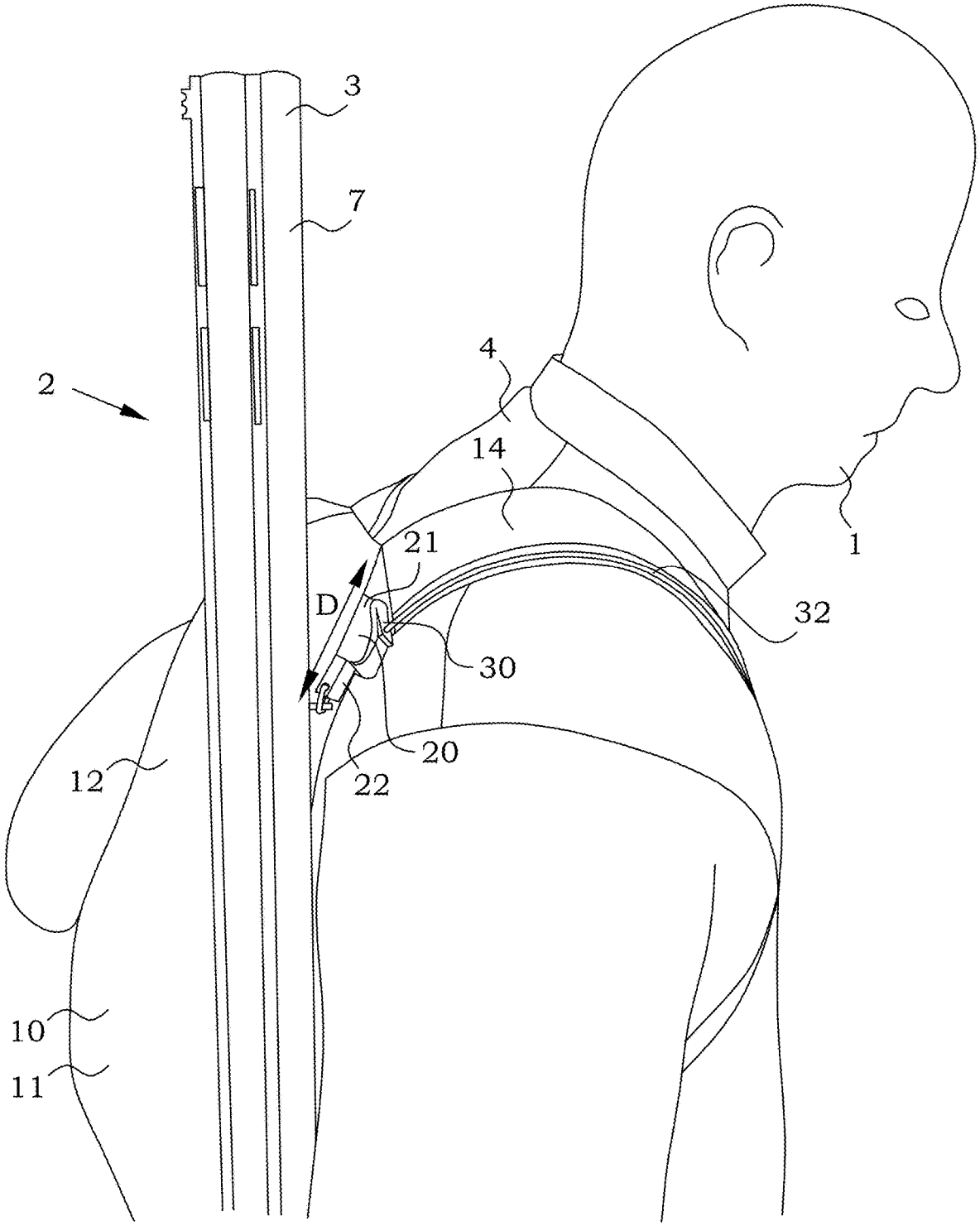
FIG. 2 is a schematic illustration of an embodiment of a carrying device with a long narrow object mounted in a carrying position.

With reference to FIG. 2, the carrying device 10 comprises an attachment member 20 intended for attachment of a long narrow object 3 to the carrying device 10. The attachment member 20 comprises a first part 21 and a second part 22, being releasable from one another. The first part 21 is in this embodiment fastened on one of the shoulder straps 14. In alternative embodiment, the first part 21 may instead be fastened to the frame or the storage pouch 12. The second part 22 is fastened to the long narrow object 3.

Irrespectively the of point of attachment, the attachment of the attachment member 20 to the carrying device 10 is chosen such that it assumes a position which is proximally behind one of the shoulders 4 of the intended user 1. Meanwhile, the second part 22 of the attachment member 20, is configured to allow attachment to a long narrow object 3. Preferably, the point of attachment of the second part 22 to the long-narrow object 3 is chosen such that it is offset relative to the long-narrow object's 3 center of gravity. Such a position of the attachment point will, by means of gravitational forces, automatically arrange the long narrow object 3 in an essentially vertical direction. This arrangement thereby allowing freedom of motion to the intended user 1 when the long narrow object 3 is secured in the carrying device 10.

Figure 3:
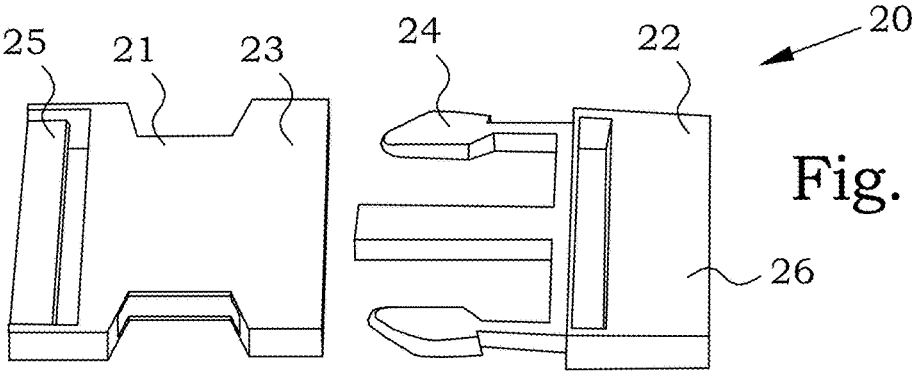
FIG. 3 is a schematic illustration of an embodiment of an attachment member.
Figure 4A:
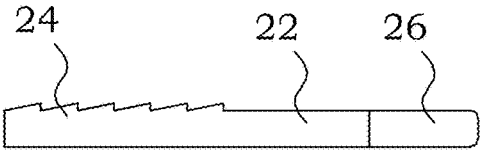
FIGS. 4A-4F are schematic illustrations of an alternative embodiment of an attachment member.
Figure 4B:
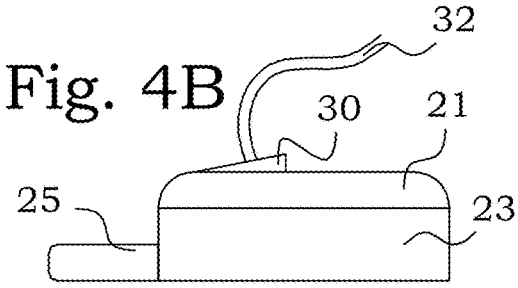
Figure 4C:
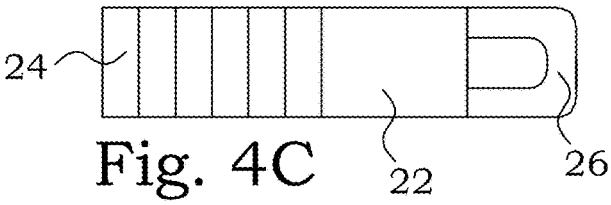
Figure 4D:
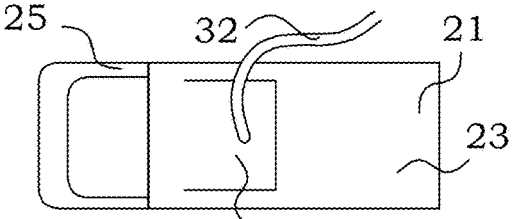
Figure 4E:
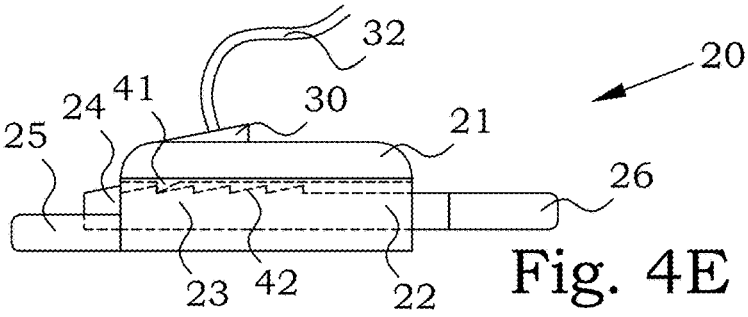
Figure 4F:
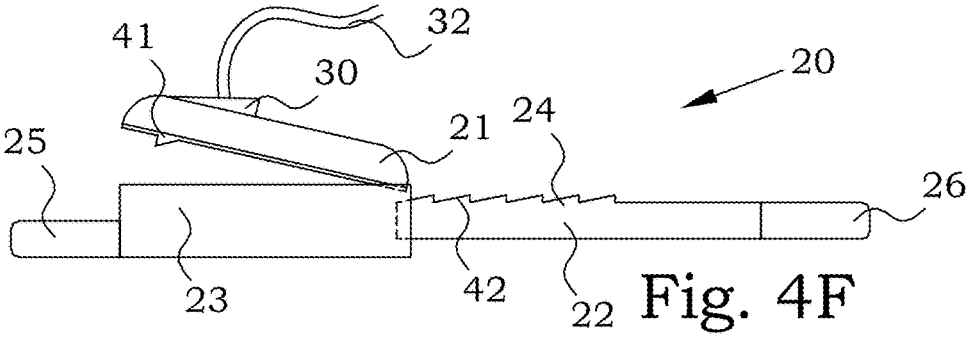

FIG. 3 illustrates one embodiment of an attachment member 20. The first part 21 and second part 22 have a respective connecting end 23, 24 and a respective fixation end 25, 26. The connecting ends 23, 24 of the first part 21 and second part 22 of the attachment member 20 are configured to receive one another and lock the first and second parts 21, 22 together. The fixation end 25 of the first part 21 of the attachment member 20, is fastened on the storage pouch(es), the shoulder strap(s) or the frame. The fixation end 26 of the second part 22 of the attachment member 20, is configured to allow attachment to a long narrow object.

The carrying device described thus far enables a long-narrow object to be carried at ease, together with additional items in the pouch(es), leaving the hands of the intended user free, hence reducing the risk of injury when moving though rough and semi-rough terrain. However, it may still be difficult to achieve access to the long narrow object quickly, if that is needed. Therefore, in another embodiment of an attachment member 20 shown in FIG. 4 A-F, the attachment member 20 further comprises release activation means 30 configured to activate a quick release function of the attachment member 20. The locking function between the first part 21 and second part 22 of the attachment member 20 is achieved by interlocking engagement portions 41, 42 on the first and second part 21, 22 respectively which inhibit relative motion of the two parts in the load direction. The interlocking engagement portion 41 is in this embodiment a single tooth-shaped protruding part with a sharp edge in one direction. The interlocking engagement portion 42 is in this embodiment a series of tooth-shaped protruding parts with sharp edges directed in a direction opposite to the single protruding part of the interlocking engagement portion 41. The sharp edges may thereby be positioned in engagement with each other, prohibiting any relative movement in one direction. By having the interlocking engagement portion 41 being kept in place by a resilient arrangement, a relative movement in the other direction may still be possible, allowing the first and second parts 21, 22 to be tightly connected.

The release activation means 30 comprises a string 32, by which the release activation means 30 can be activated. Upon activation of the quick release function via the release activation means 30, the engagement portion 41 is separated from engagement portion 42, exceeding any resilient action on the interlocking engagement portion 41, allowing the first and second part 21, 22 to be freed from one another. A quick release is thereby achieved.

Figure 5A:
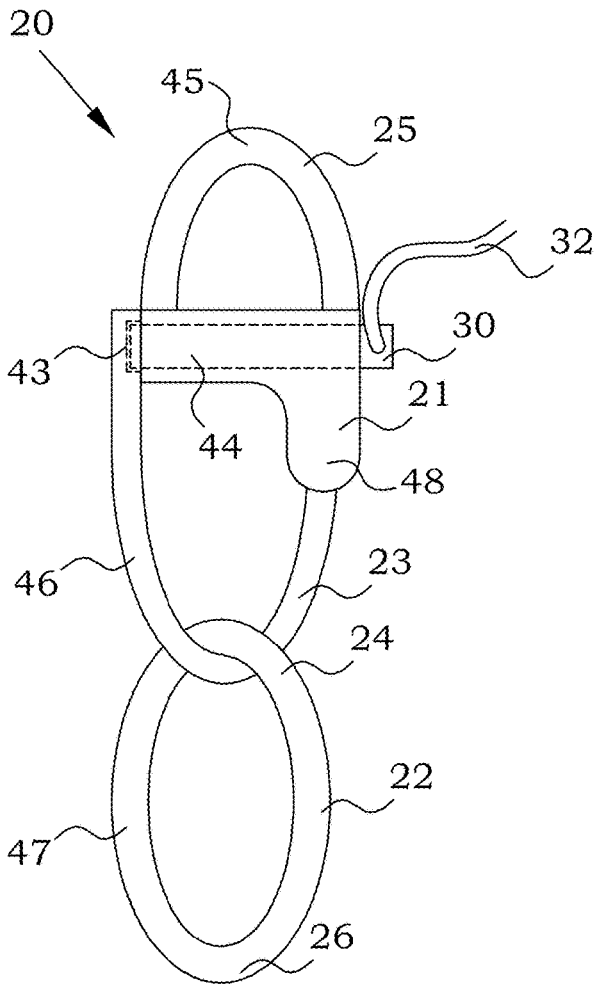
FIGS. 5A and 5B are schematic illustrates of yet an alternative embodiment of an attachment member.
Figure 5B:
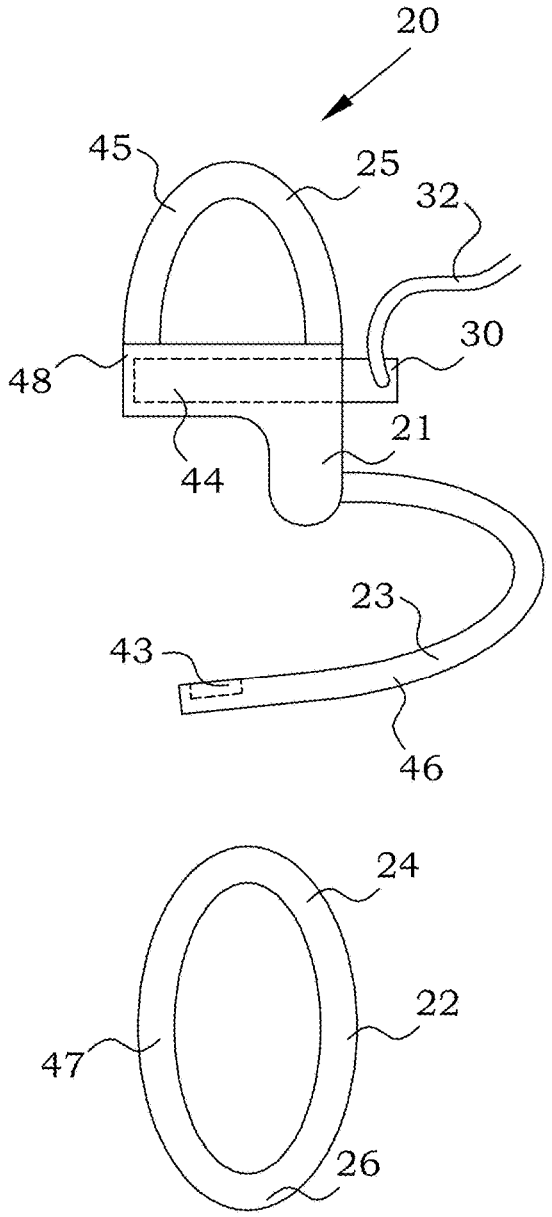

Another embodiment of an attachment member 20 with a quick release function is shown in FIG. 5A-B wherein the first part 21 of the attachment member 20 comprises a main body 48. A first bracket 45 is connected to the main body 48 of the first part 21 of the attachment member 20 at both of its ends. A second bracket 46 is hingedly attached to the main body 48 of the first part 21 of the attachment member 20 at one of its ends while its other end comprises a notch 43 which is configured to receive a locking bolt 44 when the second bracket is in its closed position. The locking bolt 44 runs though the main body 48 of the first part 21 of the attachment member 20 and locks the second bracket 46 in its closed position, preferably by a spring load. The locking bolt 44, is configured to be actuated by the release activation means 30 to achieve the quick release function of the attachment member 20. The string 32 can be used to counteract the spring load that holds the locking bolt 44 in place. In other words, the first bracket 45 constitutes the fixation end 25 of the first part 21 of the attachment member 20 while the second bracket 46 constitutes the connecting end 23 of the first part 21 of the attachment member 20 and is configured to receive the second part 22 of the attachment member 20 which is comprised of a loop 47.

Irrespectively of which embodiment is chosen, the release activation means 30 comprises a string 32 and/or rod, configured such that a pulling action of the string 32 and/or rod activates the release of the first and second parts 21, 22 of the attachment member 20 from each other. Thereby the long narrow object 3 is allowed to be easily retrievable for the intended user 1 when needed. The term string 32 of the release activation means 30 is here understood to comprise any kind of extended member, such as e.g. a wire, strip, belt or ribbon.

The release activation means 30 as described previously may assume positions which are difficult to reach for the user 1, if it is not properly secured to the carrying device 10. Hence in yet another embodiment, the release activation means 30 is confined to a release activation means holder 34 (FIG. 1) configured for retaining the string 32 and/or rod in a position easily reachable by an intended user 1, allowing the release activation means 30 to be easily reached by the intended user 1. In other embodiments, the release activation means holder 34 is a slot, hem, groove or tube. In yet another embodiment, the release activation means holder 34 as described above is instead characterized in that the release activation means holder 34 comprises a hook-and-loop fastener. In yet another preferred embodiment, the release activation means holder 34 is configured to cause the string 32 and/or rod to trail along of the shoulder strap 14 of the carrying device 10, towards the neck or chest area of the intended user 1.

Stability of the carried long-narrow object 3 is advantageous, and this is strongly influenced by the distance between the two fixation ends 25, 26 of the first 23 and second 22 of the attachment member 20. Hence, as illustrated in the embodiment shown in FIG. 2, the distance D between the two fixation ends 25, 26 of the first part 21 and the second part 22, respectively, of the attachment member 20 should not be too large. It is found that a good stability is typically achieved when the distance D does not exceed 8 centimeters when the first and second parts 21, 22 are locked to each other.

Figure 7:
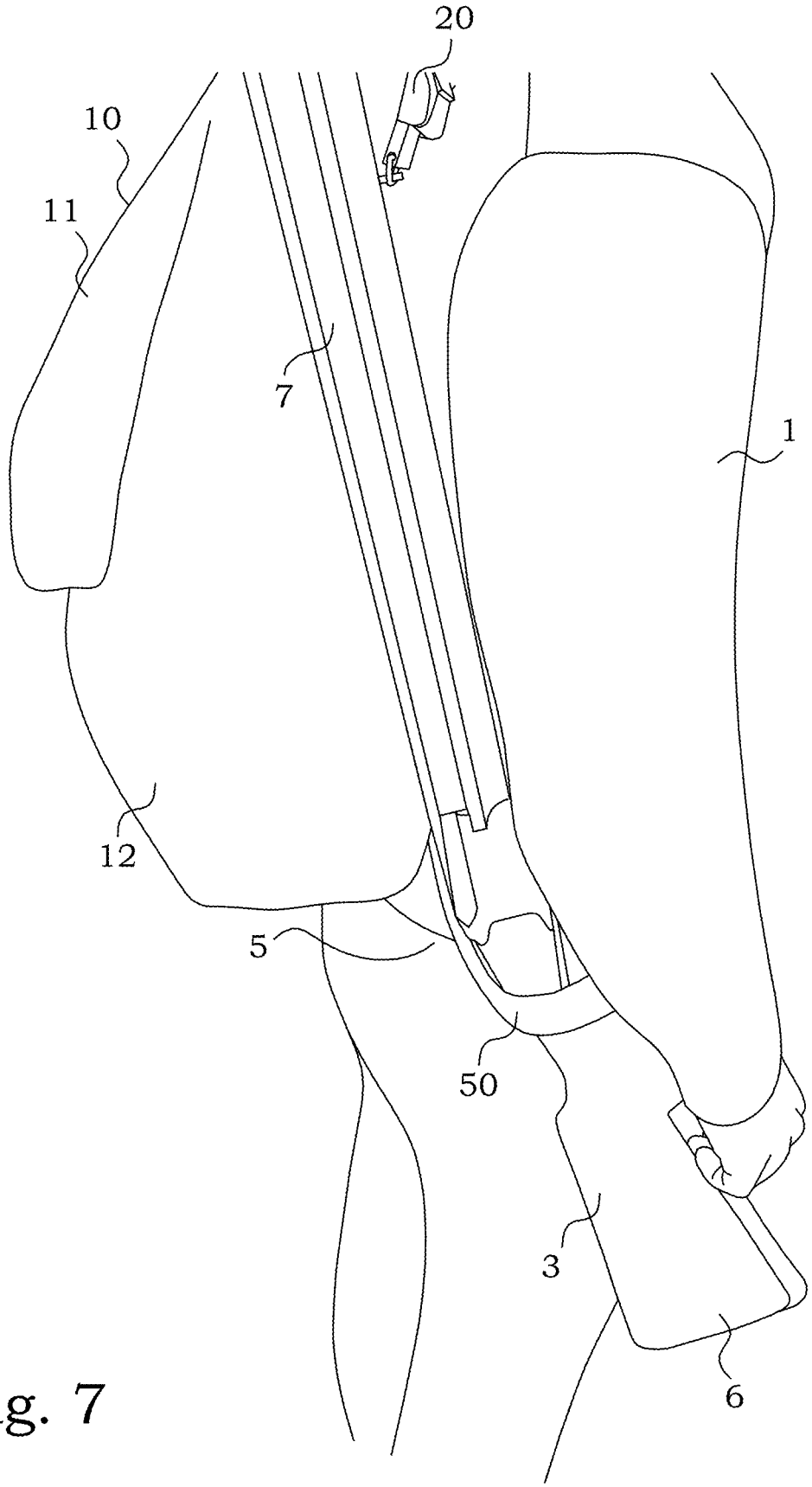
FIG. 7 is a schematic illustration of an alternative embodiment of a carrying device with a long narrow object mounted in a carrying position.

In yet another embodiment shown in FIG. 7, the stability of the long-narrow object 3 when carried in the carrying device 10 can be further increased by a lower fixation strap 50, connected to the storage pouch(es) 12, the shoulder strap(s) (14) or the frame, in a position proximal to the users 1 lower back or hip 5. Thereby, a lower end 6 of the long narrow object 3, when carried, is allowed to be secured. This later arrangement is particularly useful when the point of attachment of the fixation end 26 of the second part 22 to the long-narrow object 3 cannot be chosen such that it is offset relative to the long-narrow object's 3 center of gravity.

Figure 6:
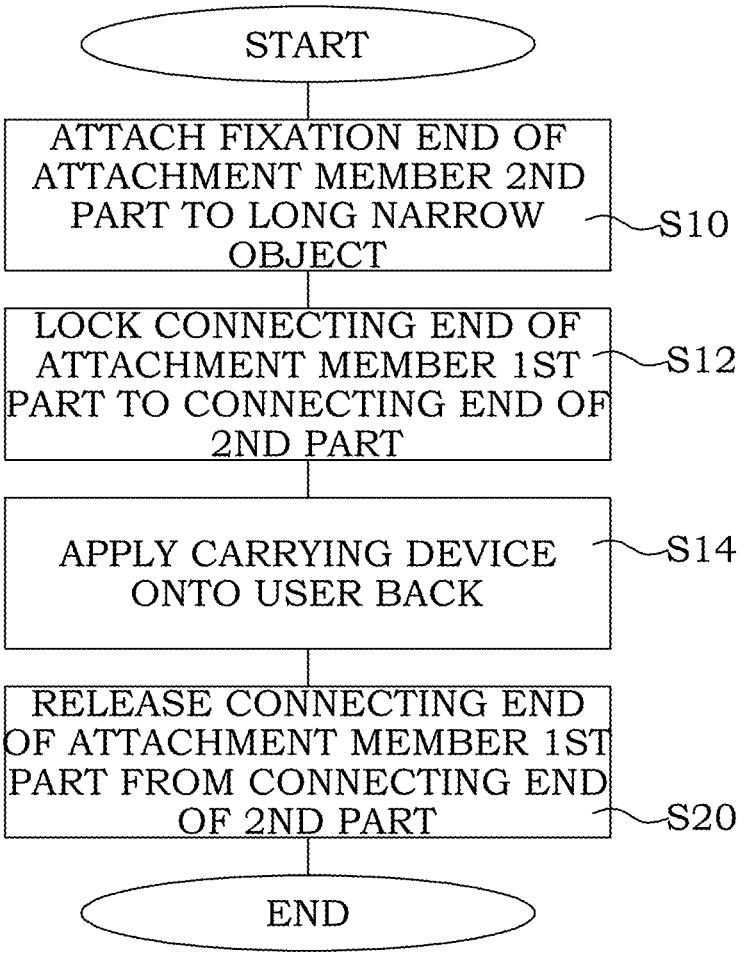
FIG. 6 is a schematic flow diagram illustrating steps of an embodiment of a method for handling a long narrow object.

In another aspect of the proposed technology, a method for handling the suggested carrying device is schematically illustrated as a flow diagram in FIG. 6. In a first instance, the method comprises the step of attaching S10 a fixation end of the second part of the attachment member to the long narrow object. This step only has to be performed once per long-narrow object as a preparing step, or when switching the second part between different long-narrow objects. Ideally, the user may have several second parts, each attached to its own long-narrow object. This would allow the user to switch between, different long-narrow objects without performing step S10. The method further comprises the step of locking S12 the connecting end of the first part of the attachment member to the connecting end of the second part of the attachment member. The user will then apply S14 the carrying device onto the back of the user by means of the shoulder strap or straps, whereby the long narrow object becomes positioned behind a shoulder of the user, allowing freedom of motion for the user. In this way, the user can use both hands for assisting in walking or skiing in rough terrain. This positioning is advantageous when both a weapon and additional items are to be transported at the same time. Whenever the long-narrow object now carried by the user is required for use, the user may perform the step of releasing S20 the connecting end of the first part of the attachment member from the connecting end of the second part of the attachment member. This may e.g. be the case when the long narrow object is a rifle, and the carrying user suddenly wants to use the rifle. This releasing allows for the long narrow object to be easily retrievable for the intended user without removing said carrying device from the back of the user, which saves both time and efforts. For this step, it is preferred to use a release activation means, configured to activate a quick release function of said attachment member.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible. The scope of the present invention is, however, defined by the appended claims.

The invention claimed is:

1. A method for handling a carrying device and a long narrow object, said long narrow object is a firearm, said carrying device having one or more storage pouches, at least one shoulder strap connected to said one or more storage pouch, optionally via a frame, an attachment member intended for attachment of said firearm, said attachment member having a first part and a second part, being fully releasable from each other, a fixation end of said first part of the attachment member is fastened on said one or more storage pouches, said at least one shoulder strap or said frame at a position relative to the intended user which is proximally behind one of the shoulders of the intended user, wherein said method comprising the steps of:

attaching a fixation end of said second part of said attachment member directly to said firearm at a single point of attachment;

locking a connecting end of said first part of said attachment member to a connecting end of said second part of said attachment member;

applying said carrying device onto a back of a user by means of said at least one shoulder strap, whereby said firearm becomes positioned behind a shoulder of said user, thereby allowing freedom of motion for the user; and releasing said connecting end of said first part of said attachment member from said connecting end of said second part of said attachment member, thereby allowing said firearm to be easily retrievable for the intended user without removing said carrying device from the back of the user.

2. The method according to claim 1, wherein said carrying device is a backpack.

3. The method according to claim 1, wherein said firearm is a rifle, and wherein the method includes attaching the fixation end of said second part of said attachment member directly to said rifle at a single point of attachment.

* * * * *